United States Patent [19]

Glackin

[11] 4,140,160

[45] Feb. 20, 1979

[54] FUEL FILLING FUNNEL WITH OIL CHARGER

[76] Inventor: Edward W. Glackin, 12299 - 145th La., North, Largo, Fla. 33540

[21] Appl. No.: 849,444

[22] Filed: Nov. 7, 1977

[51] Int. Cl.[2] ..... B65B 39/06

[52] U.S. Cl. ..... 141/332; 141/364

[58] Field of Search ..... 222/133; 141/331-345, 141/363-366, 391, 392, 297-300, 199-205, 100-110

[56] References Cited

U.S. PATENT DOCUMENTS 200,149 2/1878 Newman ..... 141/332

FOREIGN PATENT DOCUMENTS 132982 10/1919 United Kingdom ..... 141/364

*Primary Examiner*—Houston S. Bell, Jr.
*Attorney, Agent, or Firm*—C. Hercus Just

[57] ABSTRACT

A fuel filling funnel and oil charging means in which a cylindrical receptacle is hingedly connected to the rim of a conical funnel. The receptacle has a closed end provided with an adjustable discharge opening and the opposite end being open to receive a container or cartridge of lubricating oil, said end being adapted to be pivoted upwardly to discharge the oil into the funnel for mixture with liquid fuel such as gasoline which is simultaneously discharged into the funnel. Latch mechanism releasably secures the receptacle in the discharge position for the oil, the purpose being to relieve operator's hands for use to hold the funnel and a fuel nozzle while filling the tank of a two-cycle gasoline engine or the like without manually holding the oil receptacle.

8 Claims, 1 Drawing Figure

FUEL FILLING FUNNEL WITH OIL CHARGER

BACKGROUND OF THE INVENTION

There are certain types of gasoline engines, especially two-cycle engines which not only require gasoline as fuel, but also it is essential that certain proportions of lubricating oil be mixed with the gasoline in order to lubricate the very high speed moving parts of the engines. There may also be other types of gasoline engines which require lubricating oil to be mixed with the fuel in addition to such two-cycle engines. In any event, the mixing of certain proportions of lubricating oil with fuel, particularly as the same are poured into a gasoline tank for the engine, presents certain difficulties. In effect, the two hands of an operator are not always adequate to hold the funnel in the filling hole of the tank, pour or hold the nozzle of a fuel hose or can and also hold the container of lubricating oil because under best practice, the oil and fuel preferably are introduced into the tank at the same time so as to become thoroughly mixed with each other.

Certain attempts have been made previously to solve the problem of adequately holding the various items referred to above, some of them being simple, while others are relatively complex. Certain of these previous attempts are illustrated in the following U.S. Pats.:

No. 200,149, dated Feb. 12, 1878, in the name of J. Newman, illustrates a funnel and a filling can having a handle thereon which is adapted to pour powder into cartridge shells. The illustration is meager but, nevertheless, shows a simple hinge between the elongated cup-like container for the powder and the rim of a funnel which is used to introduce the powder into the cartridge shell or casing.

No. 221,137, dated Oct. 28, 1879, in the name of C. T. Wright, shows a hingedly connected measuring cup and funnel which is modified to accommodate the measuring cup, the arrangement being such that the upper end of the funnel is largely occupied by the end of the measuring cup when it is pivoted to pour the contents thereof into the funnel, whereby very little room remains for pouring fuel into the funnel, for example, while the measuring cup may be used to pour oil thereinto.

No. 2,092,062, dated Sept. 1, 1959, in the name of O. A. Von Smekal, shows a pair of concentric funnels, the central one being used to receive gasoline while the outer one receives oil, the oil-receiving space of the outer one being circular and having no provision for holding a container of oil, which, presumably must be held manually with respect to the outer portion of the funnel assembly.

No. 3,055,554, dated Sept. 25, 1962, in the name of Wight, shows a relatively sophisticated gasoline pump of the service station type on which the discharge is associated by means of a bypass with a receptacle adapted to contain oil which may be permitted to discharge into the filling hose simultaneously with gasoline when the valve to the oil receptacle is open.

It is the principal object of the present invention to provide a relatively simple funnel and oil charging or metering arrangement that is inexpensive to manufacture and requires a minimum of handling requirements incident to automatically holding a suitable receptacle or container, or even a cartridge, of lubricating oil in a manner that requires no manual holding of the same during the filling of a gasoline tank with lubricating oil and gasoline that are simultaneously introduced into the funnel and thereby thoroughly mixed during the filling of the gasoline tank, details of such object and other objects being set forth below, as follows:

SUMMARY OF THE INVENTION

It is one of the principal objects of the present invention to provide a fuel filling funnel in which a substantially conventional funnel of conical shape has a tubular discharge member extending from the small end of the funnel and a cylindrical charging receptacle, having a closed end provided with a constricted discharge opening and is open at the opposite end, is hingedly connected to the upper edge of the rim of the large end of the funnel in a manner that permits a container of lubricating oil to be inserted into the open end of the receptacle and then pivotally upended to introduce the end of the receptacle, which has the discharge opening therein, into the confines of the funnel in a manner to provide substantial space for the introduction of a nozzle from a suitable fuel tank into the confines of the funnel, the pivoted charging receptacle being latched in the discharge position referred to, so that no manual holding of the same is required and, if necessary, one hand of an operator may hold the funnel relative to the filling opening of a gasoline tank while the other hand holds the nozzle of the fuel discharge hose or container.

It is another object of the invention to provide said latch means of such nature that it preferably comprises a simple leaf spring shaped to cammingly engage a detent on the rim of the closed end of the charging receptacle for the oil, and conversely, permits ready separation of the latching mechanism at the completion of the filling operation.

Still another object of the invention is to provide the charging receptacle with a length that is substantially equal to the diameter of the large end of the funnel and the axis of the hinge on the receptacle is less than half the length of the receptacle from the closed end thereof in order to provide ample space within the funnel to receive the gasoline filling nozzle referred to above.

Other objects of the invention include the provision of a flared configuration on the open end of the oil charging receptacle to facilitate the introduction of a container or cartridge of oil thereinto; stop means on the interior of said receptacle adjacent the closed end thereof to limit the insertion of an oil container or cartridge thereinto; providing the constricted discharge opening in the closed end of the charging receptacle with adjustable means to vary the rate of discharge of the oil therefrom, and said adjustable means comprising a rotatably adjustable metering disc, having holes therein similar in pattern to additional holes provided in the closed end of the charging receptacle, whereby the rotation of the disc effects varying discharge rates of the oil.

Details of the foregoing objects and of the invention, as well as other objects thereof, are set forth in the following specification and illustrated in the accompanying drawing comprising a part thereof.

DETAILED DESCRIPTION

Figure 1:
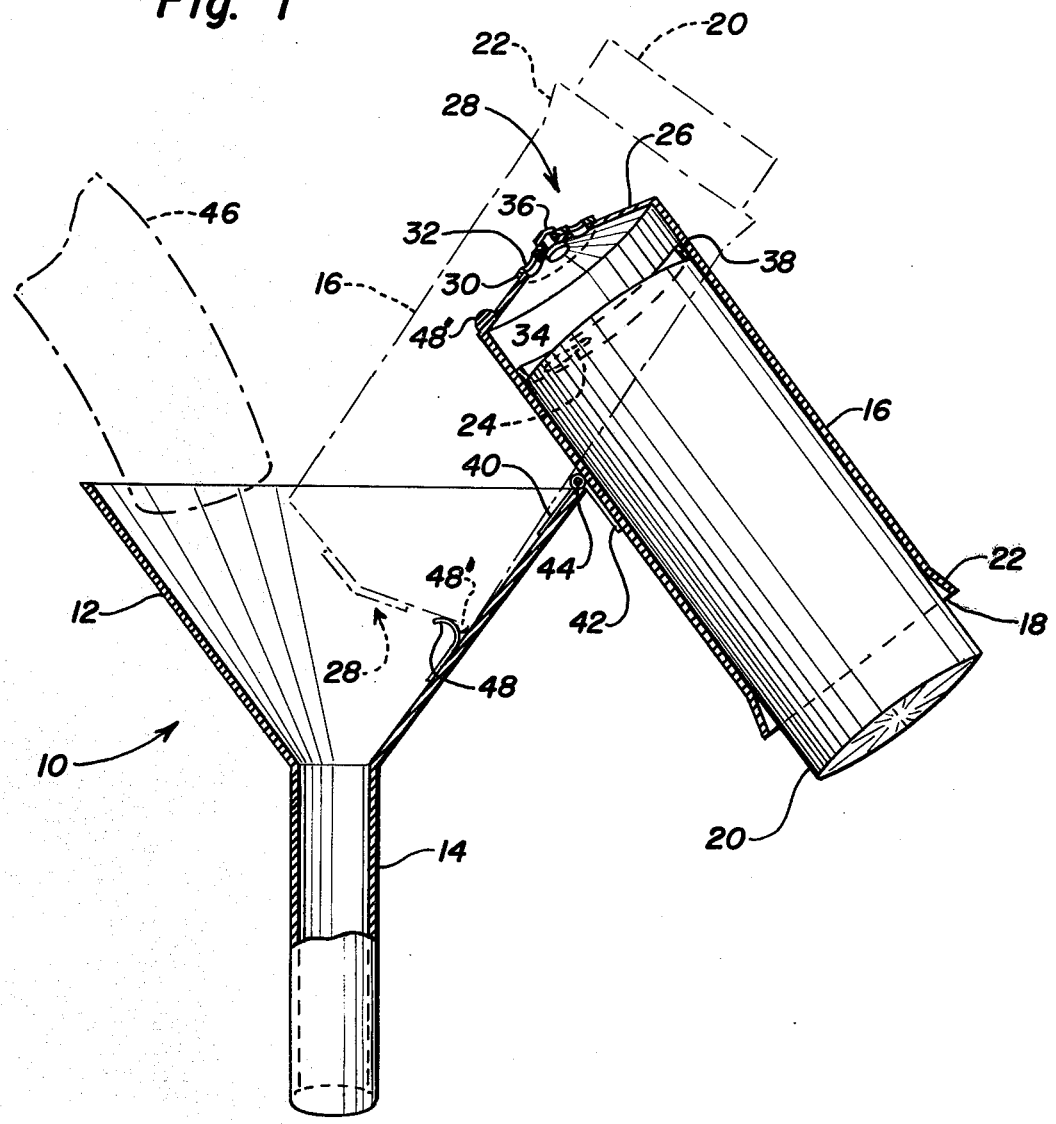
FIG. 1 is a side elevation of an exemplary funnel and oil charging receptacle shown partially in vertical section and illustrating in full lines the initial position of said receptacle with respect to the funnel and, in phantom, showing the receptacle in discharge position with respect to the funnel, said view also illustrating fragmentarily an exemplary nozzle for introducing fuel to the funnel from a hose or container.

Referring to FIG. 1, it will be seen that the present invention comprises a funnel 10 which has a conical upper portion 12 and a substantially cylindrical discharge tube 14 which is connected to and communicates with the small end of the funnel 10. The specific shape of the conical upper portion 12 may vary slightly from that illustrated in the figure, depending upon the amount of capacity desired for said portion, particularly in relation to the preferably cylindrical charging receptacle 16, which is adapted to receive within the open end 18 thereof, a container or cartridge 20 of a type to contain lubricating oil, especially lubricating oil of the type usually employed in gasoline engines which require the same to be mixed with the fuel such as gasoline. The open end 18 of receptacle 16 also preferably has a flared outer end 22 to facilitate the reception of the cartridge 20 therein. The cartridge 20 is of the type which has a suitable discharge opening 24, shown in phantom in the figure. Also, the other end of the receptacle 16 has a closure 26 extending thereacross and, if preferred, the same may be of a somewhat flat conical configuration.

The closure 20 is provided with adjustable orifice means 28 for purposes of regulating and metering the discharge of oil therefrom when the open end 18 of receptacle 16 is upended to dispose the receptacle 16 in the phantom position shown in FIG. 1. Solely for purposes of illustrating an appropriate type of adjustable orifice means 28, the illustration shown in FIG. 1 comprises a rotatable disc 30 which has a plurality of holes 32 therein and, correspondingly, the closure end 26 of receptacle 16 has a similar plurality of holes 34 therein so that the same cooperate with the holes 32 in disc 30 provide variable degrees of openings of said holes which, when in the fully open position, are coaxial with each other, such as on opposite sides of the retaining member 36 which, for example, may be a suitable rivet, nut and bolt, or otherwise.

In the preferred construction of the device, the interior of the receptacle 16 is provided with a cylindrical collar comprising a stop member 38, which may be either fixed to the inner walls of receptacle 16 or frictionally engage the same, as desired, either arrangement being for purposes of limiting the insertion of the container or cartridge 20 within the receptacle 16.

Also in the preferred construction, the length of the receptacle 16 is substantially equal to the diameter of the large or upper end of the conical upper portion 12 of funnel 10, and said receptacle is hingedly connected to the upper edge of upper portion 12 of funnel 10, clearly shown in FIG. 1, the hinge comprising a pair of leaves 40 and 42, connected by a conventional pintle 44. The attachment of lead 42 of the hinge to the receptable 16 is of a fixed nature, such as by soldering, riveting, or otherwise, not shown, and said leaf is located closer to the closure end 26 of receptacle 16 than to the open end 18, primarily in order that a lesser portion of the closure end of receptable 16 will be disposed within the confines of conical upper portion 12 of funnel 10 when the same has been upended to assume the phantom position shown in FIG. 1. This is for purposes of providing ample space to receive the pouring spout or nozzle 46 of a gasoline container or hose in order that gasoline may be discharged therefrom simultaneously while oil is being discharged into the funnel from the adjustable orifice means 28.

For purposes of minimizing the amount of manual manipulation and holding which may be required with respect to discharging oil into the funnel 10, a releasable latch means is provided which comprises a preferably leaf spring 48 suitable fixed to the inner surface of upper portion 12 of funnel 10, such as by soldering or rivets, etc., and the curved configuration of the projecting portion thereof shown in said figure cooperates with a latching detent 48' formed at the edge of the closing 26 of receptacle 16, the curvature of the spring 48 cammingly engaging said detent 48' when the receptacle 16 is in the phantom position and thereby provides an arrangement for the automatic discharge of oil at a metered rate from the container or cartridge 20 into the funnel without requiring any additional holding or manipulation by an operator.

From the foregoing, it will be seen that the present invention provides a very simple, but highly effective and durable means for accommodating and holding an oil container or cartridge within a charging receptacle 16 which, in the initial position thereof, permits said container or cartridge to be inserted thereinto without any appreciable leaking and then, simply by upending the outer end of the receptacle 16 to dispose it in downwardly extending direction within the funnel 10, as shown in phantom in FIG. 1, the receptacle is releasably latched in said position, and thereby automatically permits a metered discharge of oil into the funnel 10 while at the same time, fuel such as gasoline may be also discharge from spout or nozzle 46 into the funnel without interference with the receptacle 10 and in a manner that causes intimate mixing of the fuel with the oil as the two are discharged into the funnel for passage through the discharge tube 14 of the funnel into the fuel tank of a gasoline engine of the type which requires a mixture of such fuel and oil.

The foregoing description illustrates preferred embodiments of the invention. However, concepts employed may, based upon such description, be employed in other embodiments without departing from the scope of the invention. Accordingly, the following claims are intended to protect the invention broadly, as well as in the specific forms shown herein.

I claim:

1. A fuel filling funnel for use in filling fuel tanks of gasoline-operated engines which require addition of a predetermined proportion of lubricating oil comprising in combination a conical funnel having a discharge nozzle on the small end thereof, in combination with a cylindrical charging receptacle having a closure at one end provided with a constricted discharge opening therein and the opposite outer end being open and adapted to receive a container of cartridge of lubricating oil of predetermined amount, a hinge having a pair of pivotally connected leaves, one of said leaves being fixed to the rim of the large end of said funnel and the other leaf being fixed to the exterior of said cylindrical receptacle intermediately of the opposite ends thereof, whereby a container or cartridge of lubricating oil may be inserted within the open outer end of said receptacle and the latter then being pivotally moved upwardly in an arc to dispose the closed end of said receptacle within the confines of the conical funnel for discharge of lubricating oil directly into the funnel in a manner to provide space within the funnel for the reception of a nozzle or pouring spout of a gasoline fuel receptacle and thereby provide convenient and safe means to effect a mixture of fuel and lubricating oil for discharge into the fuel tank for a gasoline engine, and releasable means in said funnel operable to maintain said receptacle in discharging position within said funnel.

2. The funnel according to claim 1 in which said releasable means in said funnel comprises releasable latch means within said conical funnel including a latch member fastened thereto and a detent on the rim of the closed end of said cylindrical charging receptacle, said latch member and detent yieldably engaging each other detachably to retain said receptacle in discharging position within said funnel without any additional holding means.

3. The funnel according to claim 2 in which said latch member is a leaf spring having one end fixed to the inner surface of said funnel and the other end having a curved cam portion engageable with said detent on said rim of the closed end of said receptacle.

4. The funnel according to claim 2 wherein said receptacle has a length substantially equal to the diameter of the large end of said funnel and the axis of said hinge is positioned on said receptacle less than half the length of said receptacle from the closed end thereof.

5. The funnel according to claim 4 in which the open end of said receptacle is flared to facilitate the insertion of a container or cartridge of lubricating oil therein.

6. The funnel according to claim 1 in which said receptacle is provided with stop means on the interior thereof adjacent the closed end thereof and adapted to be engaged by the discharge end of a container or cartridge of lubricating oil when inserted into said receptacle to limit such insertion into said receptacle.

7. The funnel according to calim 1 in which constricted discharge opening comprises an adjustable orifice adapted to vary the rate of discharge of oil therefrom.

8. The funnel according to claim 7 in which said adjustable orifice comprises discharge hole means in said closed end and a rotatably adjustable metering disc having similar hole means cooperable with the hole means in said closed end of said receptacle.

* * * * *